United States Patent [19]

Svensson

[11] 4,086,291

[45] Apr. 25, 1978

[54] METHOD OF PRODUCING A PAVING MASS AND A PAVING MASS PRODUCED BY THE METHOD

[75] Inventor: Assar Natanael Svensson, Ersmark, Sweden

[73] Assignee: Skega AB, Ersmark, Sweden

[21] Appl. No.: 676,955

[22] Filed: Apr. 14, 1976

Related U.S. Application Data

[63] Continuation of Ser. No. 134,403, Apr. 15, 1971, abandoned.

[51] Int. Cl.[2] ..... C08L 7/00

[52] U.S. Cl. ..... 260/758; 260/28.5 AS; 106/281 R

[58] Field of Search ..... 260/28.5 AS, 758; 106/281 R

[56] References Cited

FOREIGN PATENT DOCUMENTS

| | | |
|---|---|---|
| 511,087 | 10/1930 | Germany. |
| 196,403 | 5/1965 | Sweden. |
| 465,598 | 5/1937 | United Kingdom. |

*Primary Examiner*—Melvyn I. Marquis
*Attorney, Agent, or Firm*—Fred Philpitt

[57] ABSTRACT

Producing a paving mass by heating macadam stone material, mixing rubber vulcanizate with the heated macadam for a time sufficient for the rubber vulcanizate to adhere to the heated macadam stone material, and thereafter mixing in filling material and a binding agent.

3 Claims, No Drawings

METHOD OF PRODUCING A PAVING MASS AND A PAVING MASS PRODUCED BY THE METHOD

This is a continuation of application Ser. No. 134,403, filed Apr. 15, 1971 now abandoned.

Massess containing such materials are previously known and used in a great number of different types for paving roads, streets and other ways. If the mass is intended for use in paving roads and the like, it is desirable from a wear point of view that the mass contains as much as possible of macadam, i.e., stone material larger than 8 mm. For rendering possible the binding of the macadam, a filling material or mortar is used which consists of so-called fine material of a size between 0 and 8 mm, which includes filler constituting the component smaller than 0.074 mm, and stone dust. The binding proper of the filling material and macadam is effected by means of asphalt, which preferably is added in an amount such that the mass is saturated, but not fluid, because with increased excess of asphalt increases the risk of so-called bleeding in the completed pavement. For compensating for the possible asphalt excess, or in such cases when for special reasons a pavement is desired which is fat or rich in binding agent, additional fine material is added. Thereby, however, the percentage of macadam content decreases, and the properties of the mass with respect to wear resistance deteriorates. In other words: a high macadam content renders a good wear resistance but, on the other hand, it requires to a corresponding degree a reduction of the fine material component in the mass. If the fine material component is reduced, consequently also the binding agent amount must be reduced. A reduction of the amount of binding agent involves in certain fields disadvantages, such as deteriorated adhesion between macadam and filling material, more rapid ageing by drying-up, lower elasticity etc., of which the deterioration of adhesion by far is the most serious disadvantage. For improving the adhesion between macadam, filling material and binding agent, experiments have been made, subsequent to the addition of the binding agent to add ground or crushed waste of vulcanized rubber containing one or more filling agents. These experiments, however, did not succeed in achieving an essential increase of the macadam content.

It appears from the aforesaid that the paving masses obtained by known methods are bound to certain given limits for the amounts of macadam and binding agent in a mass, and that these limits are flexible only to a small degree, the optimum values for asphalt and macadam being 7 and, respectively, 35 percent by weight in one and the same mixture. It is not possible, however, with known mixtures and methods to increase the macadam amount over said value, but it is known, for achieving a better wear resistance in a thin surface layer, to add additional macadam in such a way, that an already spread mass of a relatively poor quality is covered with macadam, which in advance had been coated with a binding agent. In this way, the macadam content can be increased by at maximum 10 percent, but only in the surface layer. Hereby a pavement is obtained which consists of a relatively strong, but thin surface layer, and a sublayer, which from a wear point of view is very poor, because after the wear-out of the surface layer the sub-layer is worn relatively rapidly. This results in a rapid deterioration of the road surface and high repair costs.

It is, thus, obvious that a pavement increases in strength with increasing amount of macadam. The primary object of the present invention is to render possible the production of a paving mass, which can contain a substantially greater amount of well-bound macadam than heretofore possible. This is achieved by the method according to the invention, which is characterized in that the macadam to be mixed together with the filling material and binding agent subsequent to heating is mixed with distributed rubber vulcanizate supplied in unsolved, i.e., solid state, whereby the rubber vulcanizate coming into contact with the macadam during the mixing is caused by the heat of the heated macadam to adhere to the surfaces of the heated stone particles in the macadam by partial thermal breakdown.

By treating the macadam in this way prior to the addition of the filling material and binding agent, the macadam content in the mass can amount to at least 65 percent by weight, which is a substantial increase even in relation to the optimum value for the macadam in existing masses. As, furthermore, the macadam can be distributed uniformly in the mass, a pavement can be obtained which shows the same high macadam content throughout and thereby has the same high wear resistance not only in the surface layer. In addition to the increase in macadam content, which as a consequence implies a reduction of the amount of filling material, the pavement mass according to the invention, owing to the presence of the rubber vulcanizate, also can contain a greater amount of binding agent than known masses, without thereby becoming fluid or bleeding in spread state. A great amount of binding agent improves the bonding of the macadam particles and prevents in an effective way these particles from loosening when they are subject to outside stresses of the type caused, for example, by tyre spikes. Due to the fact that the mass produced by the method according to the invention can contain a great amount of macadam, it further is possible, without any direct extra costs, to produce road pavements, which are considerably lighter and thereby from a traffic point of view safer than asphalt pavements.

It further was found that the rubber vulcanizate in combination with the greater amount of binding agent renders the mass in spread state more elastic than known asphalt pavements, and in the case of frost damages much more self-healing than known masses, and that it brings about properties, which effectively counteract occurring phenomena of ageing. This is of great importance specially at pavements of roadways with only a low traffic load.

For obtaining a mass particularly suitable for road pavement, it was found advantageous at first to supply rubber vulcanizate with a particle shape, which may be cubic, but which preferably has an extension larger in one direction than in the two other directions, and with a particle size between about 1 and 8 mm, measured in the direction of the greatest particle extension. This rubber vulcanizate in the following is defined as thread-shaped, but also other shapes may be comprised therein. After this thread-shaped rubber vulcanizate has adhered on the macadam, additional rubber vulcanizate in the form of powder or dust with a grain size of about 0 to 1 mm is added. Such a mass, in spread state, shows exposed rubber material, i.e., rubber threads, in the surface layer which in an effective way break down the wave formation, which in moist weather is formed ahead of the tyres, and thereby eliminates the so-called water planing. The thread-shaped rubber vulcanizate in the surface layer also contributes to a much greater braking friction between tyre and pavement, even on a dry roadway, when the road is paved with the mass according to the invention than with conventional masses.

The mass produced according to the invention, in addition to the above advantages also shows the advantage that it provides a pavement surface which at temperatures immediately below 0° C is not covered with ice to the same extent as heretofore, and which produces a substantially lower traffic sound than conventional pavements.

According to a preferred prescription, for obtaining a mass adapted for paving roads and the like, it was found suitable to add 1.35 percent by weight of thread-shaped rubber vulcanizate with a fraction, i.e. particle size, of between about 1 and 8 mm, which is mixed with the heated macadam and thereby brought to adhere thereon, whereafter additional 1.65 percent by weight of rubber vulcanizate in powder or dust state of the same type and quality as the tread-shaped rubber vulcanizate and with a fraction of between about 0 and 1 mm is added. At such an amount of rubber vulcanizate, the mass may contain at least 8.5 percent by weight of binding agent, i.e., asphalt, at least 65 percent by weight of macadam, the remainder being fine material, which thus is present in an amount much smaller than in conventional masses for road paving. The aforesaid percentage and the relation between the powdery and the thread-shaped parts of the rubber vulcanizate, on one hand, and between all constituents of the mass, on the other hand, of course, may be changed and varied to a large extent in both directions to adjust the completed mass to the intended application field and pavement type, but the percentages here indicated must be deemed to be those which provide optimum quality to masses for road pavements.

For improving the adherence, it was found suitable to prepare the thread-shaped rubber material with a primer, i.e., a pretreating agent for activating the adherence, consisting of a low-viscous asphalt solution or road tar. This primer shall be included in the rubber material preferably in such an amount that the rubber material is wetted and does not include primer in excess. This preparation preferably can be made by the rubber supplier whereafter the material suitably is stored in closed containers. The preparation of the thread-shaped rubber material has as its object, thus, to activate the adhesion between the rubber vulcanizate, the stone material and the asphalt. For the same purpose, also the macadam may be prepared with a primer, which however is not absolutely necessary.

The method according to the invention can be carried out in conventional asphalt works for hot-mixed masses, whereat the mixing temperature shall be such as to correspond to the binding agent used at the occasion in question, normally 160°–170° C. In the mixing unit, at first macadam is added which may be, but not must be, prepared with a primer and is heated to said temperature. Immediately thereafter the thread-shaped rubber material is added, preferably prepared with the aforesaid primer and possibly, but not necessarily, preheated, whilst simultaneously the mixing, i.e., stirring, is effected in order to establish contact between the thread-shaped rubber vulcanizate and the heated stone particles in the macadam. During the mixing, the macadam with a temperature of about 160°–170° C so affects the surface layer of the rubber material that the thread-shaped rubber by the heat is caused to adhere on the heated stone particles in the macadam. Thereafter the rubber vulcanizate in powder or dust state is added and mixed with the macadam thus treated, whereafter the filling material or stone dust is added. No extra filler over that contained in the stone dust (normally 6–8%) need be added, the normal method being that limestone filler must complete the remaining part up to about 10%. When homogeneity has been achieved, asphalt suitable for asphalt concrete is added, and the mixing continues until the asphalt has been worked into the mass. The mixing time is the same as for conventional asphalt masses.

The continued treatment and working of the mass according to the invention does not deviate from that for conventional masses. It is to be observed, however, that exclusively vibratory road rollers must be used for packing the mass spread, so that the binding agent is sucked up to the surface.

The invention is not restricted to the above described method, but can be varied in many different ways within the scope of the claims. This applies particularly to the percentage values, which are indicated for exemplifying a certain type of mass, and to the application field. The mass according to the invention is not restricted to just pavements of roads, streets and other ways, such as racing tracks for sports fields, runways for air-fields, but may also be used as a construction material for building purposes.

What I claim is:

1. In the known method for producing a paving mass which contains macadam, rubber vulcanizate, a filling material and a binding material in the nature of asphalt, the improvement which comprises:

(a) heating the macadam to a temperature of 160° – 170° C, (b) adding solid particles of rubber vulcanizate to said heated macadam, said particles having a dimension of between 1 and 8 mm measured in the direction of greatest particle dimension, (c) mixing said heated macadam and said solid particles of rubber vulcanizate of step (b) together for a time sufficient for said rubber vulcanizate particles to adhere to said heated macadam, (d) thereafter adding to the product of step (c) particles of rubber vulcanizate having a size less than 1 mm and effecting mixing thereof with the product of step (c), and (e) mixing the product of step (d) with both a filling material and a binding material to thereby produce a paving mass.

2. A method according to claim 1 characterized in that the rubber vulcanizate of step (b) has a substantially thread-shaped form.

3. In the known method for producing a paving mass which contains a macadam stone material, rubber vulcanizate, a filling material, and a binding material in the form of asphalt, the improvement which comprises:

(a) heating macadam stone material having a size larger than 8 mm to a temperature of 160° – 170° C, (b) adding thread-shaped solid particles of rubber vulcanizate to said heated macadam, said particles having a dimension of between 1 and 8 mm, (c) said particles of rubber vulcanizate of step (b) having been treated with a primer which activates its adhering properties, said primer being a low-viscosity asphalt or road tar, (d) mixing said heated macadam and said treated particles of rubber vulcanizate together for a time sufficient for said thread-shaped particles of rubber vulcanizate having a particle size less than 1 mm and effecting mixing of said smaller particles of rubber vulcanizate with the product of step (d), and (f) mixing with the product of step (e) both (1) asphalt and (2) a filling material selected from the group consisting of stone dust and limestone, (g) the amounts of the materials being as follows:

macadam — at least 65% by weight;

the rubber vulcanizate of step (b) — 1.35% by weight;

the rubber vulcanizate of step (e) — 1.65% by weight;

asphalt — 8.5% by weight; and filling material — 6-10% by weight.

* * * * *